US011339995B2

(12) United States Patent
Wehber et al.

(10) Patent No.: US 11,339,995 B2
(45) Date of Patent: May 24, 2022

(54) DUAL CASCADE HEAT EXCHANGER REFRIGERATION SYSTEM AND RELATED METHOD OF OPERATION

(71) Applicant: Vilter Manufacturing LLC, Cudahy, WI (US)

(72) Inventors: Wayne F. Wehber, Colgate, WI (US); Dominique D. Monney, Ste-Julie (CA); Walter F. Teeter, Mt. Ulla, NC (US); Antonio De Lourdes, Milwaukee, WI (US); Gregg Berres, Brentwood, TN (US); Matt Toone, Elm Grove, WI (US)

(73) Assignee: Vilter Manufacturing LLC, Cudahy, WI (US)

( * ) Notice: Subject to any disclaimer, the term of this patent is extended or adjusted under 35 U.S.C. 154(b) by 284 days.

(21) Appl. No.: 16/242,710

(22) Filed: Jan. 8, 2019

(65) Prior Publication Data

US 2019/0212037 A1 Jul. 11, 2019

Related U.S. Application Data

(60) Provisional application No. 62/616,350, filed on Jan. 11, 2018.

(51) Int. Cl.
*F25B 7/00* (2006.01)
*F25B 9/00* (2006.01)
(Continued)

(52) U.S. Cl.
CPC ..... *F25B 7/00* (2013.01); *F25B 9/002* (2013.01); *F25B 9/008* (2013.01); *F25B 25/005* (2013.01);
(Continued)

(58) Field of Classification Search
CPC ..... F25B 7/00; F25B 25/005; F25B 2400/06; F25B 6/02; F25B 9/002; F25B 9/008
See application file for complete search history.

(56) References Cited

U.S. PATENT DOCUMENTS 5,042,262 A 8/1991 Gyger et al.
5,335,508 A 8/1994 Tippmann
(Continued)

FOREIGN PATENT DOCUMENTS

GB 2515720 1/2015
JP 2015178920 10/2015

OTHER PUBLICATIONS

PCT/US2019/012715 International Search Report and Written Opinion of the International Searching Authority dated Apr. 3, 2019 (13 pages).
(Continued)

*Primary Examiner* — Lionel Nouketcha
(74) *Attorney, Agent, or Firm* — SmithAmundsen LLC

(57) ABSTRACT

Cooling or refrigeration systems, and methods of operating same, are disclosed herein. In one example embodiment, such a system includes a first and second high stage circuits each including a respective heat exchanger and a respective condenser that are coupled together at least indirectly so as to allow a respective portion of a first coolant to cycle therebetween. The system also includes a low stage circuit including a heat transfer device that is coupled at least indirectly with each of the heat exchangers, so as to allow an additional portion of a second coolant to cycle between the at least one evaporator and the heat exchangers, and in a parallel manner such that, if a first one of the high stage circuits ceases operating at a desired level, then the system can continue to operate by way of a second one of the high stage circuits.

19 Claims, 2 Drawing Sheets

(51) Int. Cl.

| | |
|---|---|
| ***F25B 25/00*** | (2006.01) |
| ***F25B 39/02*** | (2006.01) |
| ***F25B 39/04*** | (2006.01) |
| ***F25B 41/20*** | (2021.01) |
| *F25B 6/02* | (2006.01) |

(52) U.S. Cl.
CPC ..... *F25B 39/02* (2013.01); *F25B 39/04* (2013.01); *F25B 41/20* (2021.01); *F25B 6/02* (2013.01); *F25B 2400/06* (2013.01)

(56) References Cited

U.S. PATENT DOCUMENTS

| | | | | |
|---|---|---|---|---|
| 5,784,893 | A | 7/1998 | Furuhama et al. | |
| 6,298,683 | B1 * | 10/2001 | Kondo | F25B 7/00 62/335 |
| 7,992,397 | B2 | 8/2011 | Nemoto et al. | |
| 8,631,666 | B2 | 1/2014 | Hinde et al. | |
| 9,395,107 | B2 * | 7/2016 | Asari | F25B 30/02 |
| 9,599,395 | B2 * | 3/2017 | Yamashita | F25B 9/008 |
| 2001/0023594 | A1 | 9/2001 | Ives | |
| 2008/0289350 | A1 | 11/2008 | Shapiro | |
| 2013/0091891 | A1 * | 4/2013 | Hinde | F25B 43/02 62/470 |
| 2015/0257548 | A1 | 9/2015 | Shapiro et al. | |
| 2016/0178244 | A1 | 6/2016 | DelVentura et al. | |

OTHER PUBLICATIONS

Office Action from the European Patent Office for Application No. 19702729.5 dated Aug. 26, 2020 (3 pages).
Response to Office Action from the European Patent Office for Application No. 19702729.5 dated Feb. 26, 2021 (14 pages).
Office Action from the India Patent Office for Application No. 202047029320 dated Feb. 16, 2021 (5 pages).
Response to First Office Action from the India Patent Office for Application No. 202047029320 dated Nov. 15, 2021(4 pages).
First Office Action from the Canadian Intellectual Property Office for Application No. 3088001 dated Sep. 17, 2021 (3 pages).
Response to the First Office Action from the Canadian Intellectual Property Office for Application No. 3088001 dated Jan. 13, 2022 (26 pages).

* cited by examiner

DUAL CASCADE HEAT EXCHANGER REFRIGERATION SYSTEM AND RELATED METHOD OF OPERATION

FIELD

The present disclosure relates generally to cooling and/or refrigeration systems, and more particularly to dual (or multiple) cascade heat exchanger arrangements for implementation in a cooling and/or refrigeration system.

BACKGROUND

Many conventional refrigeration systems employ cascade heat exchangers, in which heat is exchanged between a first stage employing carbon dioxide refrigerant or coolant and a second stage employing ammonia refrigerant or coolant. However, if there is contact between the carbon dioxide refrigerant and the ammonia refrigerant, an ammonia carbonate solid can form within the heat exchanger, and this can in turn result in diminished performance (or a cessation of operation) of the heat exchanger and compression system of the refrigeration system. Although efforts can be made to provide barriers to prevent contact between carbon dioxide and ammonia within a heat exchanger, because carbon dioxide systems often operate at higher pressures than ammonia systems, there can nevertheless be a tendency for any such barriers to be breached and for the carbon dioxide (gas or liquid) to penetrate the ammonia-based portion of the refrigeration system.

Accordingly, it would be advantageous if an improved cooling or refrigeration system could be developed in which one or more of the above concerns, or one or more other concerns, could be alleviated or avoided.

BRIEF SUMMARY

In at least some example embodiments, the present disclosure relates to a cooling or refrigeration system that includes a first high stage circuit, a second high stage circuit, and a low stage circuit. The first high stage circuit includes a first heat exchanger and a first condenser that are coupled together at least indirectly so as to allow a first portion of a first coolant to cycle therebetween. The second high stage circuit includes a second heat exchanger and a second condenser that are coupled together at least indirectly so as to allow a second portion of the first coolant to cycle therebetween. The low stage circuit includes at least one heat transfer device that is coupled at least indirectly with each of the first and second heat exchangers so as to allow a third portion of a second coolant to cycle between the at least one evaporator and the first and second heat exchangers. Also, the at least one heat transfer device is coupled at least indirectly with each of the first and second heat exchangers in a parallel manner such that, if a first one of the first or second high stage circuits ceases operating at a desired level, then the system can continue to operate by way of a second one of the first or second high stage circuits.

Also, in at least some example embodiments, the present disclosure relates to a method of operating a cooling or refrigeration system that includes a first high stage parallel circuit with a first heat exchanger, a second high stage parallel circuit with a second heat exchanger, and a low stage circuit with at least one heat transfer device. The method includes operating the at least one heat transfer device so that first heat energy associated with a first fluid provided through or proximate the at least one heat transfer device is communicated to a first portion of a first coolant within the at least one heat transfer device. The method also includes operating the low stage circuit including at least one heat transfer device so as to allow the first portion of the first coolant to cycle between the at least one heat transfer device and the first and second heat exchangers.

The method further includes operating the first heat exchanger so that a first amount of the first heat energy is communicated to a second portion of a second coolant within the first heat exchanger, and operating the second heat exchanger so that a second amount of the first heat energy is communicated to a third portion of the second coolant within the second heat exchanger. Also, the method includes operating the first high stage parallel circuit so as to allow the second portion of the second coolant to cycle between the first heat exchanger and a first condenser, such that at least some of the first amount of the first heat energy is dissipated by the first condenser. Additionally, the method further includes operating the second high stage parallel circuit so as to allow the third portion of the second coolant to cycle between the second heat exchanger and a second condenser, such that at least some of the second amount of the first heat energy is dissipated by the second condenser. Further, the method includes continuing to operate a first one of the first and second high stage parallel circuits even when a second one of the first and second high stage circuits ceases to operate at a desired level as permitted by parallel coupling of the high stage parallel circuits relative to the low stage circuit.

Additionally, in at least some example embodiments, the present disclosure relates to a cooling or refrigeration system. The system includes a plurality of high stage circuits, where each of the high stage circuits includes a respective ammonia coolant portion, and where each of the high stage circuits further includes a respective heat exchanger and a respective condenser coupled at least indirectly together so that the respective ammonia coolant portion can circulate therebetween. Also, the system includes a low stage circuit including at least one heat transfer device that is coupled at least indirectly with each of the heat exchangers so as to allow a carbon dioxide coolant portion to circulate between the at least one heat transfer device and each of the heat exchangers. The respective heat exchangers are coupled in parallel with one another relative to the low stage circuit and, when operating normally, allow for transfers of heat energy from the carbon dioxide coolant portion to the respective ammonia coolant portions of the respective high stage circuits, whereby the system continues to operate notwithstanding a cessation of operation, or diminishment of operation, of a first one of the high stage circuits of the plurality of high stage circuits.

BRIEF DESCRIPTION OF THE DRAWINGS

Embodiments of cooling or refrigeration systems are disclosed with reference to the accompanying drawings and are for illustrative purposes only. The cooling or refrigeration systems and related methods of operation encompassed herein are not limited in their applications to the details of construction, arrangements of components, or other aspects or features illustrated in the drawings, but rather such apparatuses and methods encompassed herein include other embodiments or are capable of being practiced or carried out in other various ways. Like reference numerals are used to indicate like components. In the drawings.

DETAILED DESCRIPTION

The present disclosure is intended to encompass any of a variety of cooling or refrigeration systems, and associated methods of operation, in which there are multiple stages (or fluid communication circuitry) that employ multiple different coolants or refrigerants, and in which at least one of the stages (or fluid communication circuitry) includes two or more circuits. In one example embodiment encompassed herein, the cooling or refrigeration system includes two stages, a high stage and a low stage, and provides cooling utilizing two (2) high stage parallel circuits including two (2) cascade type heat exchangers. In this example embodiment, the system utilizes ammonia refrigerant on the high stage side, albeit depending upon the embodiment the high stage side can also or instead employ propane or another type of refrigerant or coolant. Also, in this example embodiment, carbon dioxide ($CO_2$) is employed on the low stage side (although other types of refrigerant or coolant can also or instead be employed), and the low stage side entails a carbon dioxide compression or pumped brine system.

In such an example embodiment, the system operates to provide cooling/refrigeration by way of the high stage rejecting heat to ambient (e.g., to the external environment) or to another medium or media through the use of the cascade heat exchangers, and thus provides cooling to the low (carbon dioxide) stage, which provides cooling to a region (e.g., a room or chamber), product, or medium/media. By virtue of having two high stage parallel circuits on the high side, the overall system is a parallel system that provides reliability in the case there is a cessation of operation (or cessation of operation at a desired level) in one of the high stage parallel circuits or one of the cascade heat exchangers thereof.

Figure 1:
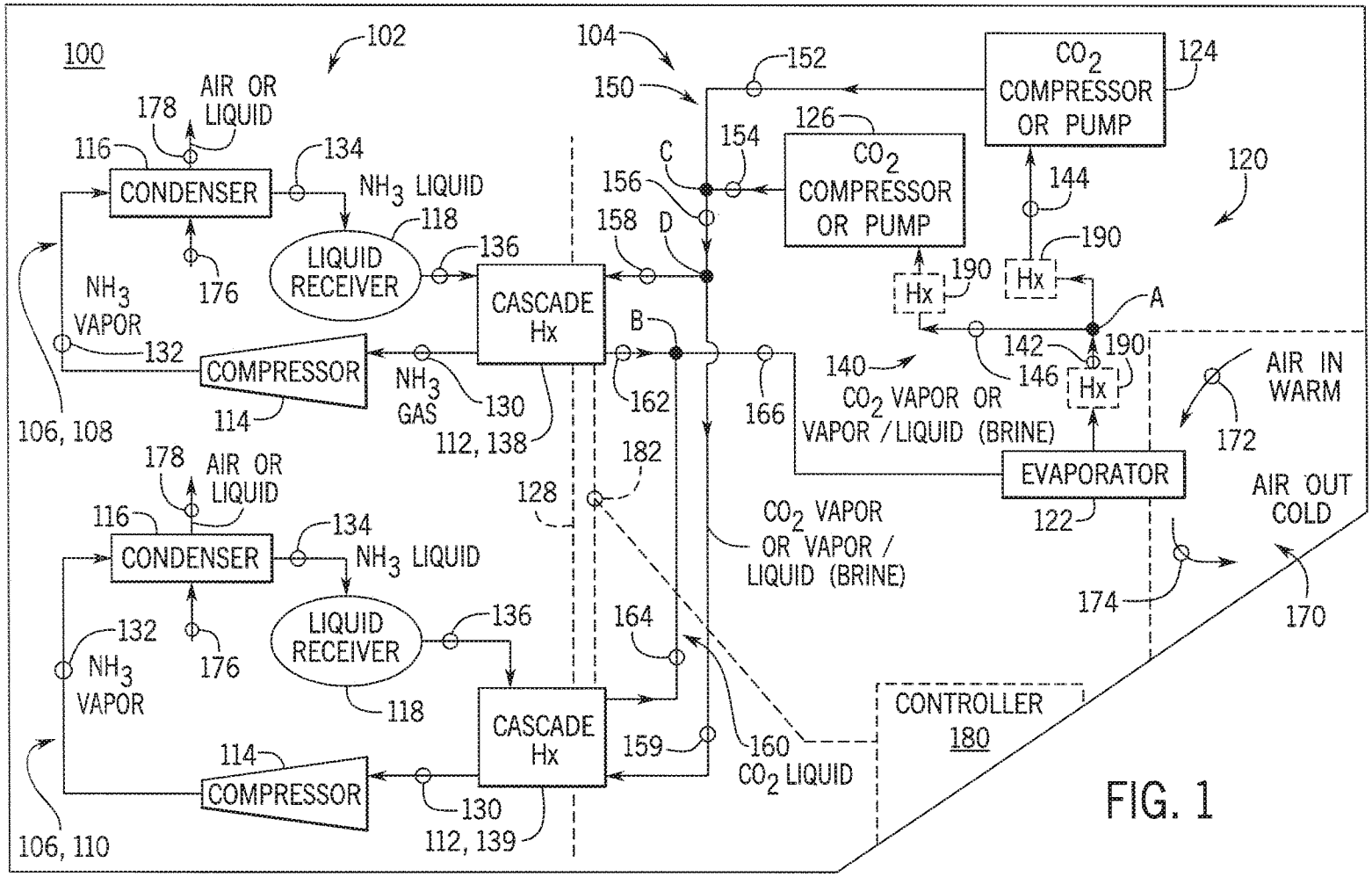
FIG. 1 is a schematic drawing illustrating a dual cascade heat exchanger refrigeration system in accordance with an example embodiment encompassed herein.

Referring now to FIG. 1, a schematic drawing is provided to illustrate a dual cascade heat exchanger refrigeration system 100 in accordance with an example embodiment encompassed herein. As shown, the refrigeration system 100 includes a high stage 102 and a low stage 104. Each of the high stage 102 and the low stage 104 includes one or more fluid circuits in which a respective refrigerant or coolant fluid cycles among various components. The high stage 102 particularly includes two high stage (or high pressure) parallel circuits 106, shown respectively as a first high stage parallel circuit 108 and a second high stage parallel circuit 110, each of which is coupled to the low stage 104. In the present example embodiment, the high stage 102 utilizes ammonia ($NH_3$) refrigerant or coolant and the low stage 104 utilizes carbon dioxide ($CO_2$) refrigerant or coolant, albeit in other embodiments (as noted above) other refrigerants or coolants can be employed (e.g., propane in the high stage 102). For purposes of this description, the terms refrigerant or coolant are used interchangeably as referring to a fluid that can absorb or give off or dissipate heat energy, with such absorption or dissipation in at least some cases being accompanied by a phase change of the fluid, and that can be communicated between different locations in a circuit and thereby communicate heat energy between those locations.

More particularly, each of the first and second high stage parallel circuits 108 and 110 of the high stage 102 includes a respective cascade type heat exchanger 112, a respective compressor 114, a respective condenser 116, and a respective liquid receiver 118. By comparison, a low stage circuit 120 of the low stage 104 includes an evaporator 122, a first $CO_2$ compressor or pump 124, and a second $CO_2$ compressor or pump 126. The aforementioned components can take any of a variety of forms depending upon the embodiment. For example, the compressors or pumps 124 and 126 can take any of a variety of forms in various embodiments encompassed herein. Further for example, in some embodiments in which one or more compressors are employed as the compressors or pumps 124 or 126, the compressors can take the form of any of reciprocating compressors, screw compressors (e.g., with single or double/twin screws), diaphragm compressors, wobble plate compressors, etc.

In the present example, a dashed line 128 can be considered a junction between the low stage 104 and the high stage 102. As illustrated, it will be appreciated that the dashed line 128 passes through both of the cascade type heat exchangers 112 because it is within those heat exchangers that heat transfer occurs between the high stage 102 and the low stage 104. Nevertheless, although each of the heat exchangers 112 could be considered to be a part of each of the high stage 102 and the low stage 104, for purposes of simplifying the description, each of the heat exchangers 112 (as described above) is considered to be a part of the high stage 102 rather than considered to be a part of both the high stage and the low stage 104.

FIG. 1 additionally illustrates how the various components of the high stage 102 are coupled with one another so as to interact with and communicate fluid flow among one another, as well as how the various components of the low stage 104 are coupled with one another so as to interact with and communicate fluid flow among one another and with respect to the heat exchangers 112 of the high stage 102. More particularly, as represented by respective arrows 130, the respective cascade type heat exchangers 112 and the respective compressors 114 of the respective first and second high stage parallel circuits 108 and 110 are coupled with one another so as to allow for the communication of ammonia in gas form from the respective heat exchangers to the respective compressors. The arrows 130 can be considered to be representative of physical hoses or other conduits, or simply orifices, linking the respective heat exchangers 112 and the respective compressors 114.

Additionally, as represented by respective arrows 132, the respective compressors 114 and the respective condensers 116 of the respective first and second high stage parallel circuits 108 and 110 are coupled with one another so as to allow for the communication of ammonia vapor from the respective compressors to the respective condensers. The arrows 132 can be considered to be representative of physical hoses or other conduits, or simply orifices, linking the respective compressors 114 and the respective condensers 116. Also, as represented by respective arrows 134, the respective condensers 116 and the respective liquid receivers 118 of the respective first and second high stage parallel circuits 108 and 110 are coupled with one another so as to allow for the communication of ammonia in liquid form from the respective condensers to the respective liquid receivers. The arrows 134 can be considered to be representative of physical hoses or other conduits, or simply orifices, linking the respective condensers 116 and the respective liquid receivers 118.

Further, as represented by respective arrows 136, the respective liquid receivers 118 and the respective cascade type heat exchangers 112 of the respective first and second high stage parallel circuits 108 and 110 are coupled with one another so as to allow for the communication of ammonia in liquid form from the respective liquid receivers 118 to the respective heat exchangers 112. The arrows 136 can be considered to be representative of physical hoses or other conduits, or simply orifices, linking the respective heat exchangers 112 and the respective liquid receivers 118. By virtue of the respective arrows 136, there is a return path for the ammonia to return to the respective cascade type heat exchangers 112, which are also respectively shown as a first heat exchanger 138 of the first high stage parallel circuit 108 and a second heat exchanger 139 of the second high stage parallel circuit 110. Accordingly, by virtue of the connections established by the respective arrows 130, 132, 134, and 136 of each of the respective first and second high stage parallel circuits 108 and 110, each of the parallel circuits is a closed circuit within which ammonia (in gas, vapor, or liquid form) flows around in a repeated, cyclic manner.

As for the low stage 104, as represented by respective arrows 140, the evaporator 122 is coupled to each of the first $CO_2$ compressor or pump 124 and the second $CO_2$ compressor or pump 126. More particularly in the present illustration, a first arrow 142 of the arrows 140 links the evaporator 122 to a node A, a second arrow 144 of the arrows 140 links the node A to the first $CO_2$ compressor or pump 124, and a third arrow 146 of the arrows 140 links the node A to the second $CO_2$ compressor or pump 126. The arrows 140 can be considered to be representative of physical hoses or other conduits, or simply orifices, linking the evaporator 122 with each of the first and second $CO_2$ compressors or pumps 124 and 126, by which carbon dioxide ($CO_2$) in vapor or vapor/liquid (brine) form is provided from the evaporator to each of those compressors or pumps. It should be appreciated that the arrows 140 shown in FIG. 1 are merely examples and that, although in the present example the node A is positioned at a location in between the evaporator 122 and each of the compressors or pumps 124 and 126 such that the overall linkage between the evaporator and the compressors or pumps takes the form of a Y, in other embodiments other linking arrangements can be employed. Further for example, in another embodiment, a pair of first and second distinct linkages can respectively be employed to connect the evaporator 122 with the respective compressors or pumps 124 and 126.

In addition to the arrows 140, the low stage 104 additionally includes arrows 150 by which both of the first and second $CO_2$ compressors or pumps 124 and 126 are coupled to both of the cascade type heat exchangers 112, that is, to both of the first heat exchanger 138 and the second heat exchanger 139. More particularly as shown, first and second arrows 152 and 154, respectively, of the arrows 150 respectively couple each of the first and second $CO_2$ compressors or pumps 124 and 126, respectively, to a node C. Further, a third arrow 156 of the arrows 150 couples the node C to a node D. Additionally, fourth and fifth arrows 158 and 159, respectively, of the arrows 150 respectively couple the node D with the first heat exchanger 138 and the second heat exchanger 139, respectively. The arrows 150 can be considered to be representative of physical hoses or other conduits, or simply orifices, linking each of the compressors or pumps 124 and 126 with each of the cascade type heat exchangers 112, by which carbon dioxide ($CO_2$) in vapor or vapor/liquid (brine) form is provided from those compressors or pumps to those heat exchangers.

Finally, as represented by respective arrows 160, each of the first and second heat exchangers 138 and 139 is coupled to the evaporator 122. More particularly in the present illustration, a first arrow 162 of the arrows 160 links the first heat exchanger 138 to a node B, a second arrow 164 of the arrows 160 links the second heat exchanger 139 to the node B, and a third arrow 166 of the arrows 160 links the node B to the evaporator 122. The arrows 160 can be considered to be representative of physical hoses or other conduits, or simply orifices, linking the evaporator 122 with each of the first and second heat exchangers 138 and 139, by which carbon dioxide ($CO_2$) in liquid form is provided from each of those heat exchanges to the evaporator. It should be appreciated that all of the carbon dioxide fluid that enters the respective first and second heat exchangers 138 and 139 by way of the arrows 158 and 159, respectively, ultimately passes through and out of the respective heat exchangers by way of the arrows 162 and 164, respectively. Accordingly, by virtue of the connections established by the respective arrows 140, 150, and 160, the low stage circuit 120 is a closed circuit within which carbon dioxide (in gas, vapor, liquid, or brine form) flows around in a repeated, cyclic manner.

It should be appreciated that, similar to what was mentioned above in regard to the arrows 140, the arrows 150 and 160 are merely representative of example interconnections among the components of the low stage 104 and the heat exchangers 138 and 139. For example, although in the present example the node B is positioned at a location between the evaporator 122 and heat exchangers 138 and 139 such that the overall linkage therebetween takes the form of a Y, in other embodiments other linking arrangements can be employed including, for example, a pair of first and second distinct linkages respectively connecting the respective heat exchangers with the evaporator. Further, although in the present example the node C is positioned at a location in between the node D and both of the compressors or pumps 124 and 126, and the node D is positioned at a location in between the node C and both of the heat exchangers 138 and 139, such that the overall linkage among these components takes the form of a X, in other embodiments other arrangements can be implemented. For example, in another example embodiment, there can be two Y-configured conduits that respectively link the respective compressors or pumps 124 and 126 with both of the heat exchangers 138 and 139.

Given the above arrangement, it should be appreciated that the dual cascade heat exchanger refrigeration system 100 generally operates as follows. More particularly, within the low stage 104, air within a region 170 that is being cooled is directed to flow through, along, or past the evaporator 122, as represented by arrows 172 and 174 indicating the air as it is entering and leaving the evaporator, respectively. The air flow can be forcibly directed, for example by way of a fan, or can occur simply due to temperature variation of the air within the region 170 or for other reasons. It will be appreciated that the air as it enters the evaporator 122, as represented by the arrow 172 ("air in warm"), will typically be at a temperature that is warmer than that of the air leaving the evaporator 122, as represented by the arrow 174 ("air out cold"). Although the region 170 is shown as being part of the refrigeration system 100, it can also be considered to be a region external of the refrigeration system, that is, the refrigeration system can be understood to be a system (e.g., a cooling system) that serves to cool an environment or other region outside of the refrigeration system.

Due to the flow of the air through, along, or past the evaporator 122, carbon dioxide passing through the evaporator is warmed so as to take on a vapor form or a combination vapor and liquid (brine) form, and is then passed to the first and second $CO_2$ compressors or pumps 124 and 126 as represented by the arrows 140. Upon the carbon dioxide reaching the first and second $CO_2$ compressors or pumps 124 and 126, those compressors or pumps in turn pump or direct that carbon dioxide in its vapor form, or possibly in a vapor/liquid (brine) form, to each of the cascade type heat exchangers 112 (138 and 139) as represented by the arrows 150. The carbon dioxide can take on a vapor/liquid (brine) form particularly in embodiments in which the compressors or pumps 124 and 126 are pumps, and will typically take on a vapor form particularly in embodiments in which the compressors or pumps 124 and 126 are compressors. When the compressors or pumps 124 and 126 are pumps, in at least some embodiments, one or more heat exchangers 190 are optionally included between the evaporator 122 and one more of the respective pumps. For example as shown in FIG. 1, a single one of the heat exchangers 190 can be located between the evaporator 122 and node A. As another example, also shown in FIG. 1, two separate ones of the heat exchangers 190 can be positioned between node A and the respective pumps 124 and 126. Also it should be appreciated that, when the compressors or pumps 124 and 126 are compressors, in at least some embodiments, one or more heat exchangers 190 also can be optionally included between the evaporator 122 and one or more of the respective compressors so as to provide superheating and thereby avoid (or reduce) the feeding of liquid into the compressors. The heat exchangers 190 are shown in dashed lines in FIG. 1 to indicate that the heat exchangers are optional depending upon the embodiment.

Within the heat exchangers 112, heat transfer occurs between the carbon dioxide and the ammonia present therewithin. In particular, the ammonia is warmed to become a gas, and correspondingly the carbon dioxide is cooled, returning to a liquid state. Thus, as represented by the arrows 160, the carbon dioxide returns to the evaporator 122, at which the carbon dioxide can again be warmed such that the cycle within the low stage 104 can be repeated.

Upon the ammonia being heated within each of the respective heat exchangers 138 and 139 of the respective first and second high stage parallel circuits 108 and 110, the ammonia takes on a gas form and proceeds from the respective heat exchangers within those respective parallel circuits to the respective compressors 114 within those respective parallel circuits, as represented by the respective arrows 130. The respective compressors 114 serve to compress the ammonia so that it becomes ammonia vapor, which then is provided from the respective compressors to the respective condensers 116 within the respective first and second high stage parallel circuits 108 and 110, as represented by the respective arrows 132. The respective condensers 116 in turn are components at which heat contained within the ammonia is removed from the vapor and dissipated elsewhere.

More particularly as shown, each of the respective condensers 116 not only receives ammonia but also is exposed to either air or liquid that flows through, along, or past the respective condensers. Respective arrows 176 shown in FIG. 1 are indicative of such air or liquid as it is entering each respective condenser 116, and respective arrows 178 are indicative of such air or liquid as it is leaving each respective condenser 116. Due to the ammonia passing proximate to the air or liquid represented by the arrows 176 and 178 proximate to or within the respective condensers 116, heat is transferred from the ammonia to the air or liquid and out of the respective condensers 116. Although the arrows 176 and 178 show the air or liquid as entering and exiting the respective condensers 116 from and to the interior of the refrigeration system 100, it should be appreciated that in other embodiments the air or liquid can enter and exit the respective condensers 116 from and to other locations, such as other locations in the external environment.

Upon the ammonia being cooled at the respective condensers 116, the ammonia takes a liquid form. As represented by the respective arrows 134, the ammonia in this liquid form passes from the respective condensers 116 to the respective liquid receivers 118. In the present embodiment, the liquid receivers 118 simply serve as reservoirs for the ammonia although, in other embodiments, the liquid receivers can serve one or more additional or alternate purposes including, for example, providing pumping of the ammonia. Additionally as shown, upon the ammonia reaching the respective liquid receivers 118, the ammonia (still in the liquid form) then returns to the respective heat exchangers 112 (138 and 139) as indicated by the respective arrows 136. Accordingly the ammonia, having been cooled by way of the condensers 116, can again be heated at the heat exchangers 112 due to its being in proximity to the carbon dioxide communicated via the arrows 150, such that the cycles within the first and second high stage parallel circuits 108 and 110 of the high stage 102 can be repeated.

It should be appreciated that, although during normal operation the ammonia is heated and cooled in both of the first and second high stage parallel circuits 108 and 110 of the high stage 102, this need not always be the case. Indeed, in the present embodiment, each of the respective heat exchangers 112 (138 and 139) can be operated independently of one another. This is particularly possible because the respective heat exchangers 112, and correspondingly the respective high stage parallel circuits 106, are coupled in parallel with one another relative to the low stage 104 such that the carbon dioxide refrigerant can be provided to and returned from each of the respective heat exchangers independently of whether carbon dioxide refrigerant is provided to or returned from the other of the respective heat exchangers.

Given this to be the case, one of the heat exchangers 112 can be operated even though the other one of the heat exchangers is not operating. Correspondingly, the respective heat exchangers 112 and the respective high stage parallel circuits 106 with which those respective heat exchangers are associated can be isolated relative to one another and/or relative to the low stage 104. This can be particularly advantageous if, for any reason, there is any contact between the ammonia of the high stage 102 and the carbon dioxide of the low stage 104 in either of the heat exchangers 112 or otherwise. Indeed, in the event either of the heat exchangers 112 ceases to operate in a desired manner or at a desired level because of any contact between ammonia and carbon dioxide (or for another reason), the refrigeration system 100 can continue to operate normally, or substantially or largely normally, by way of the other remaining heat exchanger and associated high stage parallel circuit. Thus, even if the first heat exchanger 138 and correspondingly the first high stage parallel circuit 108 ceases operating in a desired manner or at a desired level (which can include a complete cessation of operation), the refrigeration system 100 can continue to operate via the second heat exchanger 139 and correspondingly the second high stage parallel circuit 110, and vice-versa.

In some embodiments the refrigeration system can continue to operate normally, or substantially or largely normally, even when one of the heat exchangers 112 (138 or 139) and a corresponding one of the high stage parallel circuits 106 (108 or 110) cease to operate, without any active intervention or control actions being taken to facilitate such continued operation. Nevertheless, in other embodiments encompassed herein, the respective heat exchangers 112 (and correspondingly the respective high stage parallel circuits 106) can be actively and independently switched on or switched off (or shut down), or isolated from one another and/or from the low stage 104. More particularly, in some such embodiments the refrigeration system can include one or more control devices and associated sensors and actuators to achieve such continued operation notwithstanding a circumstance in which one of the heat exchangers 112 (and a corresponding one of the high stage parallel circuits 106) ceases to operate.

For example, in some such embodiments, the refrigeration system 100 includes a controller 180 as shown by a dashed box in FIG. 1. Further as illustrated by dashed lines, in such embodiments the controller 180 is coupled to each of the first and second heat exchangers 138 and 139 by way of one or more communication linkages 182. Also in some such embodiments, the controller 180 can be a microprocessor, a microcontroller, a programmable logic device, or other control mechanism, and the communication linkages 182 can be, for example, wired or wireless communication linkages. In some cases, further for example, the communication linkages 182 can include or involve dedicated or proprietary communication linkages, or Ethernet or internet-type linkages. Although the controller 180 is shown to be part of the refrigeration system 100 in FIG. 1, in other example embodiments the controller can also be located remotely from the refrigeration system.

Further in regard to some such embodiments employing a controller and communication linkages such as the controller 180 and communication linkages 182, one or more sensors (not shown) can be provided within or in relation to the first and second heat exchangers 138 and 139. By way of such sensors, the controller 180 is able to receive signals from or concerning any one or more of the heat exchangers 138 and 139 that are indicative of the operational status of the respective heat exchangers, and the controller is thereby able to determine whether any one or more of the heat exchangers is or are not operating at a desired level. The sensors can take any of a variety of forms depending upon the embodiment including, for example, pressure sensors within or nearby the heat exchangers (e.g., at or near the ammonia outlet ports thereof as represented by the arrows 130) to detect changes in the pressure of the ammonia that may occur due to solid formation at or near the heat exchangers. In additional embodiments, sensors can also be provided at one or more other locations in the high stage parallel circuits 106 and/or at one or more other locations in the low stage circuit 120 to sense operation of the heat exchangers or other operational characteristics of the high pressure parallel or low stage circuits. In at least some embodiments, the sensors can be considered to constitute parts of the heat exchangers, even if positioned upstream or downstream of the heat exchangers in terms of fluid flow into or out of the heat exchangers.

Additionally by way of the communication linkages 182, and by way of one or more actuators (not shown) provided within the first and second heat exchangers 138 and 139, the controller 180 also is able to communicate command signals to any one or more of the heat exchangers or associated components. By sending appropriate command signals, the controller 180 can cause the respective heat exchangers 112 or associated components within the high stage parallel circuits 106 to cease operating (or to shut down or become isolated from the remainder of the refrigeration system), or to start operating, or to attain a different level or mode of operation. In some cases, the command signals provided to such actuators can cause one or more internal (e.g., check) valves or other control mechanisms associated with the heat exchangers 138 and 139 to switch or be adjusted so as to reduce, limit, or preclude fluid flow (e.g., carbon dioxide or ammonia) into or out of the heat exchangers. In at least some such embodiments, the valves or other control mechanisms, and/or the actuators, can be considered to constitute parts of the heat exchangers, even if positioned upstream or downstream of the heat exchangers in terms of fluid flow into or out of the heat exchangers. In additional embodiments, actuators can also be provided at one or more other locations in the high stage parallel circuits 106 and/or at one or more other locations in the low stage circuit 120 to govern or influence operation of the heat exchangers or other operational characteristics of the high pressure parallel or low stage circuits.

Notwithstanding the features of the refrigeration system 100 shown in FIG. 1, the present disclosure is intended to encompass numerous other embodiments or arrangements having one or more features that are in addition to or different from those of FIG. 1. For example, in some other embodiments, a high stage can include one or more additional high stage parallel circuits in addition to merely the first and second high stage parallel circuits 108 and 110 of FIG. 1 (e.g., there can be three or more high stage parallel circuits). Also for example, in some other embodiments, a low stage can include one or more additional low stage circuits that are coupled in parallel to the low stage circuit shown in FIG. 1 (e.g., there can be two or more low stage circuits that are coupled in parallel with one another). Also, depending upon the embodiment, the refrigerant/coolant provided in one or both of the low stage and high stage can differ from the carbon dioxide and ammonia described above (e.g., propane instead of ammonia).

Figure 2:
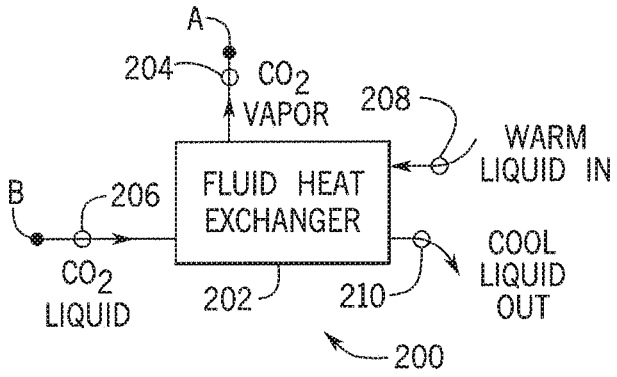
FIG. 2 is a schematic drawing illustrating a portion of an alternate heat exchanger refrigeration system that can be implemented in place of a portion of the dual cascade heat exchanger refrigeration system of FIG. 1, so as to form the alternate heat exchanger refrigeration system, in accordance with an additional example embodiment encompassed herein.

Also for example, one alternate embodiment of the refrigeration system 100 of FIG. 1 encompassed herein is a refrigeration system that is identical to the refrigeration system 100 except insofar as a low stage circuit portion of the refrigeration system 100 comprising the evaporator 122 is replaced with a low stage circuit portion 200 as shown in FIG. 2. As illustrated in FIG. 2, the low stage circuit portion 200 particularly includes, in place of the evaporator 122, a fluid heat exchanger 202 that is coupled between the nodes B and A shown in FIG. 1 by way of arrows 206 and 204, respectively, instead of the arrows 166 and 142, respectively. As with others of the arrows discussed above, the arrows 206 and 204 can be considered to be representative of physical hoses or other conduits, or simply orifices, linking the fluid heat exchanger 202 with the nodes B and A. Similar to the evaporator 122, the fluid heat exchanger 202 would receive a warm fluid in from a region corresponding to the region 170 of FIG. 1 (or from another location in the external environment), and output a cold or cooled fluid out to that region (or to another location in the external environment). However, in contrast to the evaporator 122, as represented by arrows 208 and 210 in FIG. 2, in the case of the fluid heat exchanger 202 the fluid entering the fluid heat exchanger as indicated by the arrow 208 would be a liquid (rather than air or other gas) and the fluid exiting the fluid heat exchanger as indicated by the arrow 210 would be a liquid (rather than air or gas). In other respects, operation of a refrigeration system encompassing the low stage circuit portion 200 can be identical or substantially similar to operation of the refrigeration system of FIG. 1.

Figure 3:
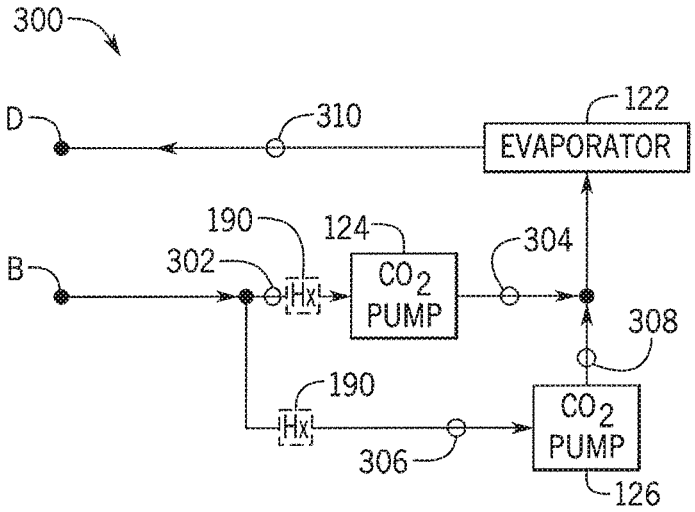
FIG. 3 is a schematic drawing illustrating a portion of another alternate heat exchanger refrigeration system that can be implemented in place of a portion of the dual cascade heat exchanger refrigeration system of FIG. 1, so as to form the other alternate heat exchanger refrigeration system, in accordance with a further example embodiment encompassed herein.

Notwithstanding the features of the refrigeration system 100 shown in FIG. 1 or FIG. 2 or otherwise described above, the present disclosure is intended to encompass numerous other embodiments or arrangements having one or more features that are in addition to or different from those of FIG. 1 or FIG. 2 or otherwise described above. Further for example, with reference to FIG. 3, an additional alternate embodiment of the refrigeration system 100 of FIG. 1 encompassed herein is a refrigeration system that is identical to the refrigeration system 100 except insofar as the low stage circuit portion of the refrigeration system 100 comprising the evaporator 122 and $CO_2$ compressors or pumps 124 and 126 is replaced with a low stage circuit portion 300 as shown in FIG. 3. As illustrated in FIG. 3, the compressors or pumps 124 and 126 specifically take the form of one or more pumps only. Such pumps can be located between the respective heat exchangers 112 (138 and 139) and the evaporator 122, as shown, thereby receiving from the respective heat exchangers 112 (138 and 139) and providing to the evaporator 122 only liquid.

As illustrated in FIG. 3, the $CO_2$ pumps 124 and 126 are respectively coupled between node B and the evaporator 122 by way of arrows 302 and 306, which respectively link node B with the respective pumps, and arrows 304 and 308, which respectively link the respective pumps with the evaporator. The evaporator 122 is coupled to node D by way of a channel represented by an arrow 310. As with others of the arrows discussed above, the arrows 302, 304, 306, 308, and 310 can be considered to be representative of physical hoses or other conduits, or simply orifices, linking the $CO_2$ pumps 124 and 126 and the evaporator 122 with one another or with the nodes D and B as shown. Also as illustrated, in at least some embodiments, the arrows 302 and 306 can together be representative of a Y-shaped conduit (or channel) such that, over a portion of the distances between the node B and the respective $CO_2$ pumps 124 and 126, the arrows 302 and 306 are referring to one and the same conduit (or channel). Likewise, in at least some embodiments, the arrows 304 and 308 can together be representative of a Y-shaped conduit (or channel) such that, over a portion of the distances between the respective $CO_2$ pumps 124 and 126 and the evaporator 122, the arrows 304 and 308 are referring to one and the same conduit (or channel). Additionally as illustrated by dashed lines in FIG. 3, in at least some embodiments one or more of the heat exchangers 190 discussed above with respect to FIG. 1 can optionally be positioned in front of (upstream of) one or both of the $CO_2$ pumps 124 and 126, following (downstream of) the node B. When provided in this manner, the one or more of the heat exchangers 190 can perform a subcooling operation with respect to the fluid being communicated from the node B to one or both of the $CO_2$ pumps 124 and 126.

From the above description, it should additionally be appreciated that the present disclosure is intended to encompass not only numerous different embodiments of cooling systems or refrigeration systems but also numerous different methods of operating such systems. Indeed, FIG. 1, FIG. 2, and FIG. 3 not only illustrate such cooling and refrigeration systems, but also illustrate such methods of operating such systems. For example, FIG. 1 illustrates how one example system described herein operates through the passing of fluid by at least one heat exchanger of a low stage circuit, so as to warm or heat up a first (e.g., carbon dioxide) coolant within that low stage circuit. Also, FIG. 1 shows how the system further operates by passing that first coolant through dual cascade heat exchangers arranged in parallel with one another, by which heat is transferred from that first coolant to two additional portions of a different coolant that are present within two high stage circuits. Further, FIG. 1 illustrates how the two additional portions of the different coolant circulate within the high stage circuits, which also are arranged in parallel with one another relative to the low stage circuit (and which can be considered as including the heat exchangers), to condensers of those high stage circuits, so as to give off heat via those condensers. By virtue of the high stage circuits being arranged in parallel, the overall system can continue to operate even if one of those high stage circuits (or portions thereof, such as one of the heat exchangers) ceases to operate normally or at a desired level.

It is specifically intended that the present invention not be limited to the embodiments and illustrations contained herein, but include modified forms of those embodiments including portions of the embodiments and combinations of elements of different embodiments as come within the scope of the following claims.

What is claimed is:

1. A cooling or refrigeration system comprising:

a first high stage circuit including a first heat exchanger and a first condenser that are coupled together at least indirectly so as to allow a first portion of a first coolant to cycle therebetween;

a second high stage circuit including a second heat exchanger and a second condenser that are coupled together at least indirectly so as to allow a second portion of the first coolant to cycle therebetween;

a controller coupled to each of the first and second heat exchangers by way of one or more communication linkages, wherein the controller receives signals indicative of an operational status of the first and second heat exchangers and thereby determines that a first one of the first or second high stage circuits ceases operating at a desired level, and causes the first one of the first or second high stage circuits to cease operating and the system to proceed with operating by way of a second one of the first or second high stage circuits when the first one of the first or second high stage circuits ceases operating at the desired level; and a low stage circuit including at least one heat transfer device that is coupled at least indirectly with each of the first and second heat exchangers so as to allow a third portion of a second coolant to cycle between the at least one heat transfer device and the first and second heat exchangers, wherein the at least one heat transfer device is coupled at least indirectly with each of the first and second heat exchangers in a parallel manner such that, if the first one of the first or second high stage circuits ceases operating at the desired level, then the system can continue to operate by way of the second one of the first or second high stage circuits.

2. The cooling or refrigeration system of claim 1, wherein the first coolant includes ammonia.

3. The cooling or refrigeration system of claim 2, wherein the second coolant includes carbon dioxide.

4. The cooling or refrigeration system of claim 3, wherein the first high stage circuit additionally includes a first compressor coupled at least indirectly with the first condenser and the first heat exchanger, and the second high stage circuit additionally includes a second compressor coupled at least indirectly with the second condenser.

5. The cooling or refrigeration system of claim 4, wherein the first high stage circuit additionally includes a first liquid receiver coupled at least indirectly with the first condenser and the first heat exchanger, and the second high stage circuit additionally includes a second liquid receiver coupled at least indirectly with the second condenser.

6. The cooling or refrigeration system of claim 5, wherein the first high stage circuit is configured so that the first portion of the first coolant is provided from the first heat exchanger to the first compressor, from the first compressor to the first condenser, from the first condenser to the first liquid receiver, and the from the first liquid receiver to the first heat exchanger, and wherein the second high stage circuit is configured so that the second portion of the first coolant is provided from the second heat exchanger to the second compressor, from the second compressor to the second condenser, from the second condenser to the second liquid receiver, and the from the second liquid receiver to the second heat exchanger.

7. The cooling or refrigeration system of claim 6, wherein the first portion of the first coolant takes a first gaseous or vapor form when provided between the first heat exchanger and the first condenser, and takes a first liquid form when provided between the first condenser and the first heat exchanger, and wherein the second portion of the first coolant takes a second gaseous or vapor form when provided between the second heat exchanger and the second condenser, and takes a second liquid form when provided between the second condenser and the second heat exchanger.

8. The cooling or refrigeration system of claim 3, wherein the at least one heat transfer device includes an evaporator or a fluid heat exchanger.

9. The cooling or refrigeration system of claim 8, wherein the low stage circuit additionally includes one or more compressor or pump devices.

10. The cooling or refrigeration system of claim 9, wherein the one or more compressor or pump devices of the low stage circuit comprise more than one compressor or pump devices, and the more than one compressor or pump devices include a first compressor or pump device and a second compressor or pump device.

11. The cooling or refrigeration system of claim 9, wherein the low stage circuit is configured so that the third portion of the second coolant is provided from the at least one heat transfer device to the one or more compressor or pump devices, and then from the one or more compressor or pump devices to the first and second heat exchangers of the first and second high stage circuits, and then from the first and second heat exchangers to the at least one heat transfer device.

12. The cooling or refrigeration system of claim 11, wherein the third portion of the second coolant takes a first gaseous or vapor or brine form when provided between the at least one heat transfer device and the one or more compressor or pump devices, takes either the first gaseous or vapor or brine form or a second gaseous or vapor or brine form when provided between the one or more compressor or pump devices and the first and second heat exchangers, and takes a third liquid form when provided from the first and second heat exchangers to the at least one heat transfer device.

13. The cooling or refrigeration system of claim 8, wherein the at least one heat transfer device includes the evaporator, and wherein the evaporator operates to communicate heat from air conducted through or along the evaporator to the third portion of the second coolant so as to warm the third portion of the second coolant.

14. The cooling or refrigeration system of claim 13, wherein the air is received either from a region within the system or from an external environment location.

15. The cooling or refrigeration system of claim 8, wherein the at least one heat transfer device includes the fluid heat exchanger, and wherein the fluid heat exchanger operates to communicate heat from liquid conducted through or along the fluid heat exchanger to the third portion of the second coolant so as to warm the third portion of the second coolant.

16. The cooling or refrigeration system of claim 1, wherein the first heat exchanger and the second heat exchanger are each a cascade heat exchanger.

17. The cooling or refrigeration system of claim 1, wherein the controller is configured to receive first signals from the heat exchangers that allow for monitoring of the heat exchangers and to transmit second signals to the heat exchangers that allow for commands to be sent to the heat exchangers.

18. A method of operating a cooling or refrigeration system that includes a first high stage parallel circuit with a first heat exchanger, a second high stage parallel circuit with a second heat exchanger, and a low stage circuit with at least one heat transfer device, the method comprising:

operating the at least one heat transfer device so that first heat energy associated with a first fluid provided through or proximate the at least one heat transfer device is communicated to a first portion of a first coolant within the at least one heat transfer device;

operating the low stage circuit including the at least one heat transfer device so as to allow the first portion of the first coolant to cycle between the at least one heat transfer device and the first and second heat exchangers;

operating the first heat exchanger so that a first amount of the first heat energy is communicated to a second portion of a second coolant within the first heat exchanger;

operating the second heat exchanger so that a second amount of the first heat energy is communicated to a third portion of the second coolant within the second heat exchanger;

operating the first high stage parallel circuit so as to allow the second portion of the second coolant to cycle between the first heat exchanger and a first condenser, such that at least some of the first amount of the first heat energy is dissipated by the first condenser;

operating the second high stage parallel circuit so as to allow the third portion of the second coolant to cycle between the second heat exchanger and a second condenser, such that at least some of the second amount of the first heat energy is dissipated by the second condenser; and receiving, by a controller coupled to each of the first and second heat exchangers by way of one or more communication linkages, signals indicative of an operational status of the first and second heat exchangers, and thereby determining by the controller that a first one of the first or second high stage circuits ceases operating at a desired level;

causing by the controller the first one of the first or second high stage circuits to cease operating, and the system to proceed with operating by way of a second one of the first or second high stage circuits as permitted by parallel coupling of the high stage parallel circuits relative to the low stage circuit.

19. The method of claim 18, wherein the first coolant is carbon dioxide and the second coolant is ammonia.

* * * * *